United States Patent [19]

Finean

[11] Patent Number: 5,067,292

[45] Date of Patent: Nov. 26, 1991

[54] BRACKET SYSTEM

[76] Inventor: Andrew M. Finean, 37, Brydale House, Rotherhithe New Road, Surrey Docks, London SE16 2PT, United Kingdom

[21] Appl. No.: 354,620

[22] Filed: May 19, 1989

[30] Foreign Application Priority Data

May 19, 1988 [GB] United Kingdom ..... 8811833

[51] Int. Cl.[5] ..... E04B 2/88

[52] U.S. Cl. ..... 52/235; 52/126.4

[58] Field of Search ..... 52/235, 126.4, 506, 52/508, 511, 471, 475, 510, 772

[56] References Cited

U.S. PATENT DOCUMENTS

| | | | |
|---|---|---|---|
| 3,315,426 | 4/1967 | Rolland | 52/235 |
| 3,913,287 | 10/1975 | Chapman, Jr. | 52/235 X |
| 4,060,951 | 12/1977 | Gere | 52/235 X |
| 4,070,835 | 1/1978 | Revèrend et al. | 52/235 |
| 4,307,551 | 12/1981 | Crandell | 52/235 |
| 4,782,635 | 11/1988 | Hegle | 52/235 X |

FOREIGN PATENT DOCUMENTS

| | | | |
|---|---|---|---|
| 1609503 | 3/1970 | Fed. Rep. of Germany | 52/235 |
| DE2221762 | 11/1973 | Fed. Rep. of Germany . | |
| 2364370 | 6/1975 | Fed. Rep. of Germany | 52/235 |
| DE1683167 | 10/1977 | Fed. Rep. of Germany . | |
| DE3405254 | 8/1985 | Fed. Rep. of Germany . | |
| FR1395895 | 3/1965 | France . | |
| FR2387329 | 4/1977 | France . | |
| 46561 | 8/1963 | Poland | 52/235 |
| 720114 | 3/1980 | U.S.S.R. | 52/235 |

*Primary Examiner*—Richard E. Chilcot, Jr.
*Attorney, Agent, or Firm*—Gifford, Groh, Sprinkle, Patmore and Anderson

[57] ABSTRACT

The specification discloses a bracket system for positioning and supporting a component, such as a cladding panel (16), relative to the structure of a building. The system comprises brackets (18,20) fixed to the structure, each of which receives a support member (22) attached to the rear of a cladding panel (16).

The brackets (18,20) disclosed include plates (38,40,60) defining an enclosure which receives a support member (22) and which is movable along one axis. The enclosure is shaped to restrict relative movement of the support member (22) along this axis while allowing relative movement along another, transverse axis. The support member (22) may include jack means to allow movement along a third axis.

11 Claims, 7 Drawing Sheets

BRACKET SYSTEM

This invention relates to a bracket system, more particularly to a bracket system which is suitable for supporting and positioning components of a building, such as cladding panels.

For some time the construction industry has been moving away from traditional 'on-site' building methods, and this has been highlighted by the methods used for constructing the components of a building. As architects and engineers have demanded more elaborate and precise components on increasingly large buildings, the restraints of labor costs and site conditions have made the on-site construction or manufacture of these components impractical. The production of some components has therefore been moved off-site into factories, which fabricate the components ready for inclusion in a building.

The cladding panel is an example of a component which is usually manufactured off-site. Cladding panels are designed to be attached to the structure of a building, fitting together to form the walls and thus to produce the external finish of the completed building. The panels may be produced complete with windows, doors, radiators and the like and may be of any practicable size, the upper limit being dictated by transport limitations between factory and site. This upper limit is of the order of 6 m$\times$12 m, and a panel of that size may weigh six tons or more.

It is clearly important to the function and appearance of a building incorporating cladding panels that the panels are positioned as accurately as possible in relation to the structure of the building and in relation to each other. However, several factors militate against accurate positioning in practice. Firstly, the structure of the building is not completely static but is designed to act elastically receiving and distributing stresses. Therefore when for instance a floor slab is cast, the adjacent structural members will deflect, moving slightly from their ideal position. Moreover, although the degree of settlement of the structure can be calculated and allowed for by foundation engineering techniques, these calculations can never be exact. On large buildings in particular, differential settlement of up to say 20 mm may occur between one column and another and this settlement may take several years to manifest itself.

It is also difficult to control the placement of a column and this usually involves placing the column, determining the positioning error at the top of the column, and forcing the top back into the correct position with jacks or winches which may result in the column becoming distorted. In any event, inaccuracies are inevitable during the setting-out of a structure and if these inaccuracies are not considered excessive they are often left uncorrected.

It will be clear that as a result of these problems a building may incorporate considerable inaccuracies, will deform whenever loads are varied, and will be subject to settlement for several years after completion. All of these factors make truly accurate positioning of cladding panels difficult if not impossible in practice.

Recent years have seen the introduction of the fast-track system in which a building is erected in the manner of a production line manufacturing system. In the fast-track system, specialist trades work on a given part of the building one after another in quick succession, so for example fire protection specialists may be working on the first floor of the building while the floor slab has just been cast on the third floor and only the steelwork has been completed on the seventh floor. The cladding panels should be fixed in place as soon as possible before other tradesmen move in, and ideally as soon as each floor slab is cast.

In existing arrangements, cladding panels are attached to the structure of a building by brackets which are themselves attached to the structure only after the structure has been erected. These brackets may take many shapes and forms but in general need to be very accurately positioned when they are attached to the structure if they are to support the cladding panels in the correct position. This is because existing brackets cannot allow for any more than minor variations in the position of the panel relative to the structure. Positioning is therefore a complex and time-consuming process, a process that cannot be commenced until a sizeable portion of the building has been completed.

An object of this invention is to provide an improved bracket system which overcomes or mitigates the disadvantages of existing systems.

According to this invention there is provided a bracket for supporting and positioning a component on a structure in use, the bracket being capable of controlling movement of the component in two directions.

According to one aspect of this invention there is provided a bracket system including a plurality of brackets for supporting and positioning a building component on a structure in use, wherein a first bracket is adapted to control movement of the component along a first axis, while permitting movement along a second axis transverse to the first axis, and a second bracket is adapted to control movement of the component along the second axis while permitting movement along the first axis.

In a preferred embodiment, one of the first and second brackets is also adapted to control movement of the component along a third axis transverse to both the first and second axes, and the other of the first and second brackets is also adapted to permit movement along the third axis. The first, second and third axes are preferably mutually perpendicular to one another, one axis being vertically aligned and the other axes being horizontally aligned.

According to another aspect of this invention there is provided a bracket for supporting and positioning a building component on a structure in use, including means for receiving a portion of the component and means for moving or constraining the movement of the component along a first axis while permitting movement of the component along a second axis transverse to the first axis.

Embodiments of this invention will now be described, by way of example, with reference to the accompanying drawings in which:

FIG. 1 is an elevational view of a typical structural framework, showing some possible locations for brackets according to this invention;

FIGS. 2(*a*) and 2(*b*) are sectional views showing details of FIG. 1;

Figure 8:
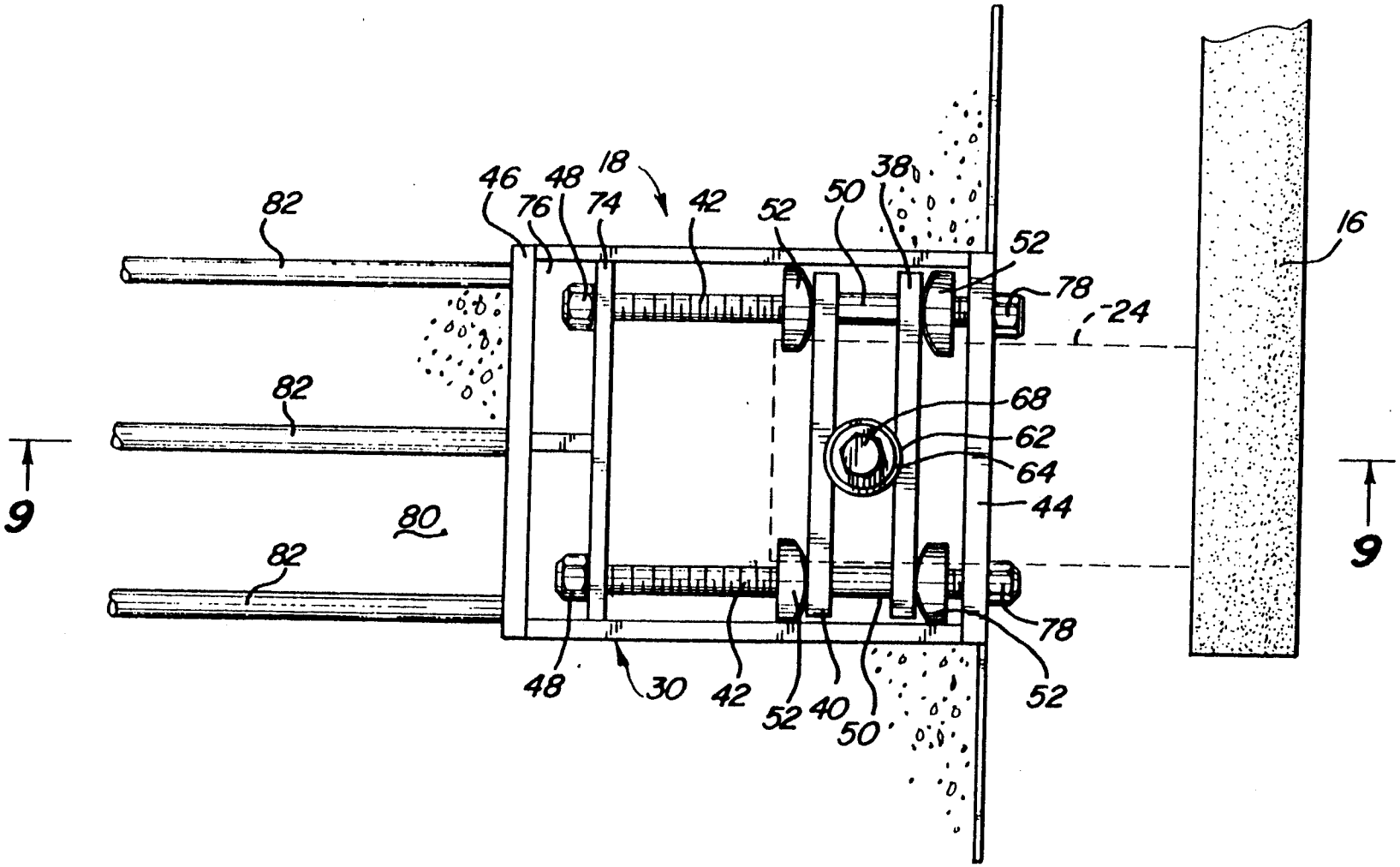
FIG. 8 is a plan view of another form of bracket according to this invention.
Figure 9:
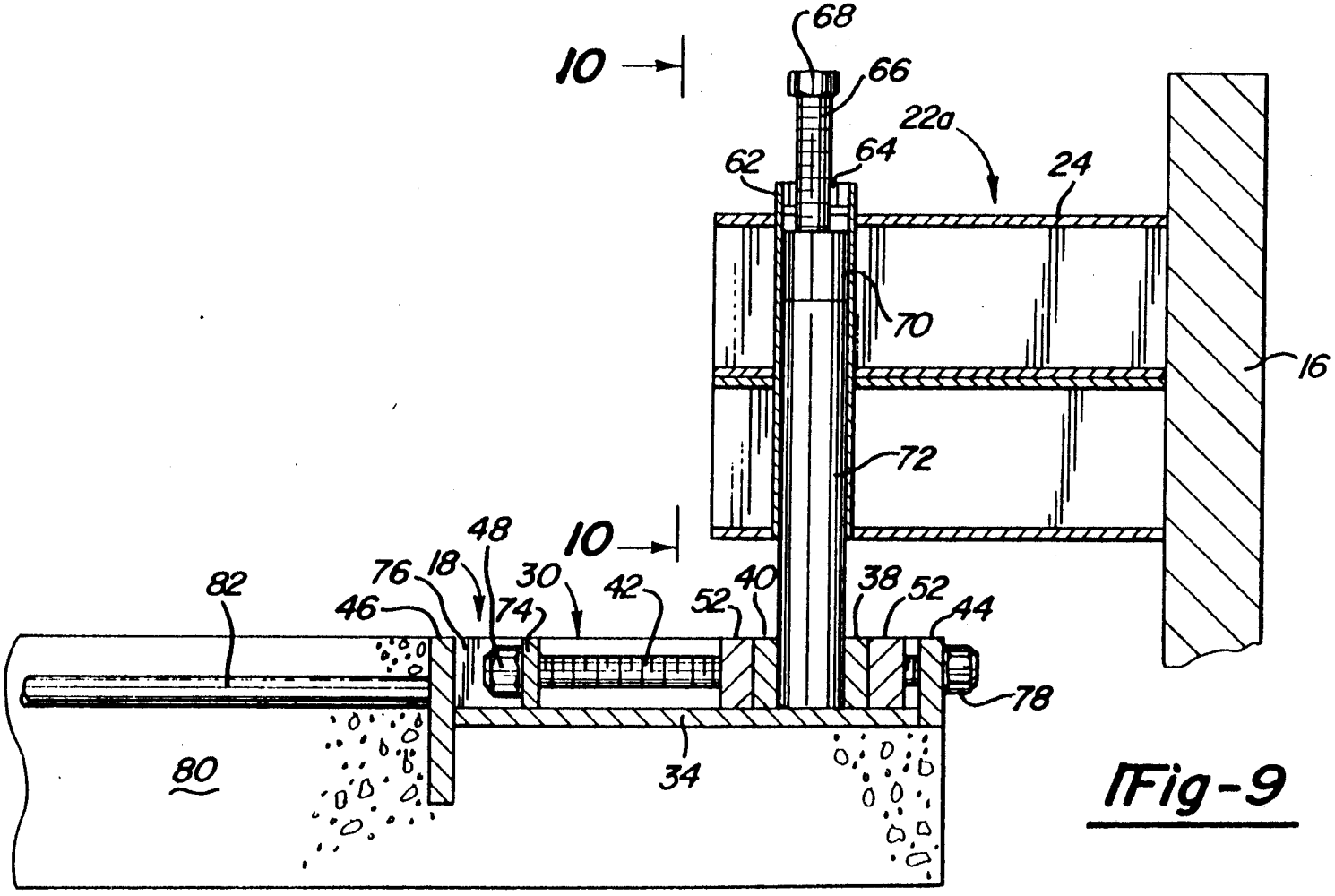
FIG. 9 is a sectional side view taken along line IX—IX of FIG. 8.
Figure 11A:
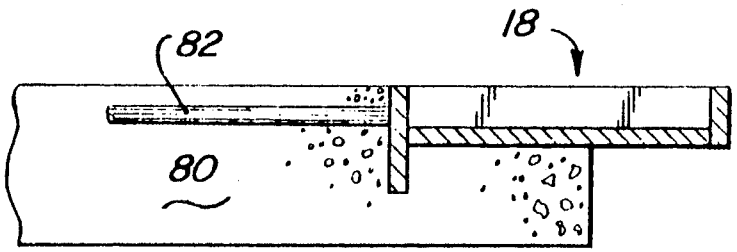
Figure 11B:
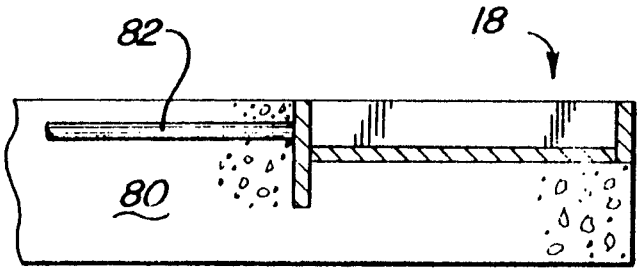
Figure 10:
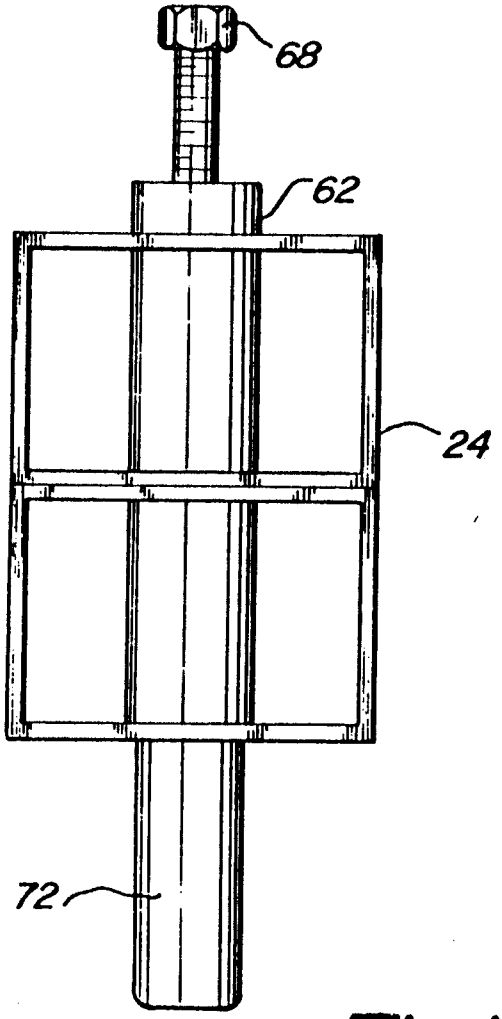
FIG. 10 is a rear elevational view showing a detail of FIGS. 8 and 9 viewed from line X—X in FIG. 9.

FIGS. 11(*a*) and 11(*b*) are schematic sectional side views showing two possible arrangements corresponding to FIGS. 8, 9 and 10.

Figure 1:
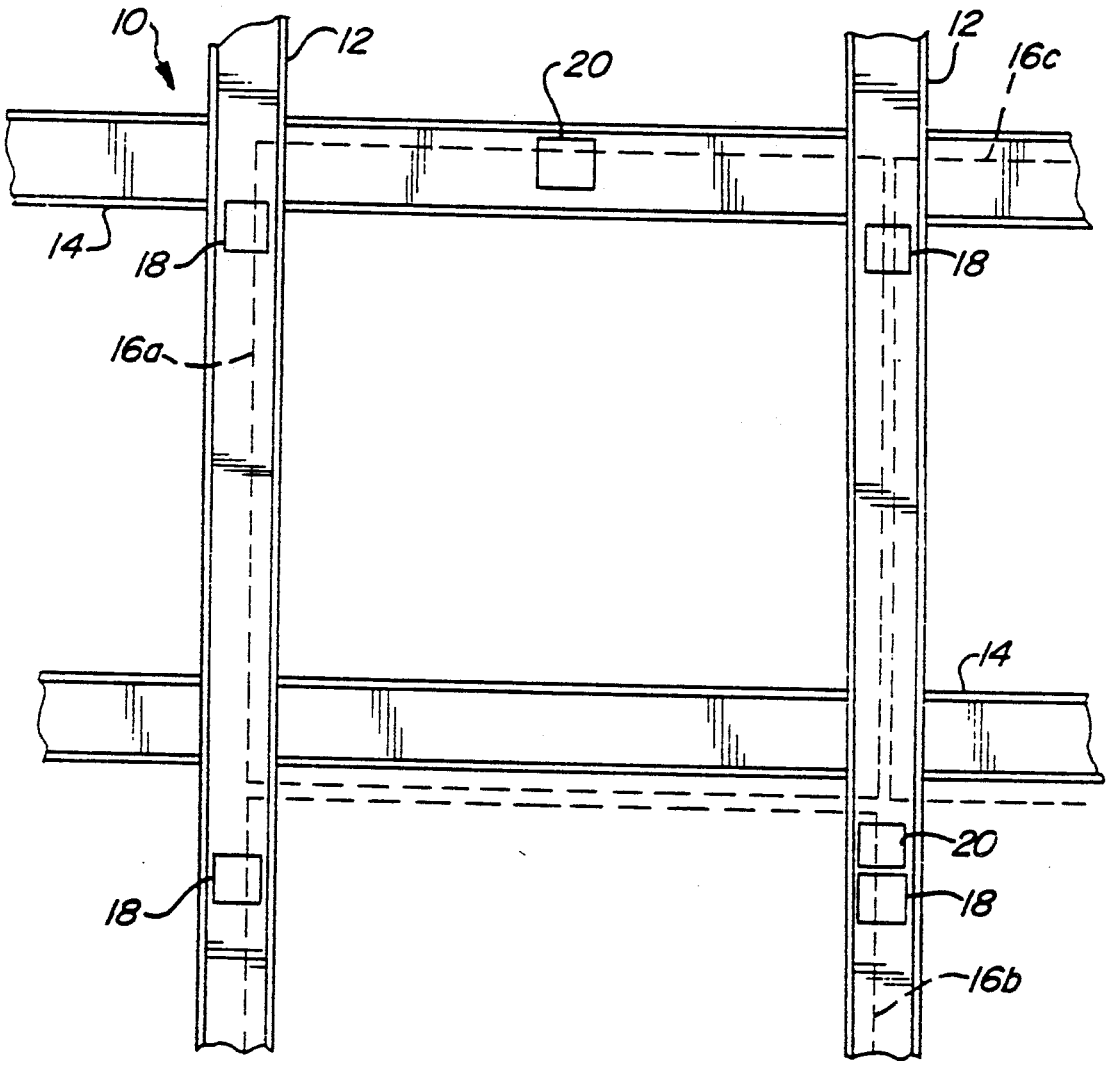

Referring to FIG. 1 of the drawings, a structural framework 10 comprises a plurality of spaced vertical columns 12 linked by a plurality of spaced horizontal beams 14 in the usual manner. The framework 10 supports, and is enclosed by, a plurality of cladding panels 16. The outlines of three cladding panels 16*a*, 16*b* and 16*c* are shown in dotted lines in typical positions; it will be clear that the panels may be of any suitable shape or size and may be positioned in any appropriate position relative to the columns and beams constituting the framework.

In the preferred embodiment illustrated, each panel 16 is attached to the framework 10 by a total of three brackets; two of the brackets (18) are identical to one another and are each attached to a column 12, the other bracket (20) is preferably attached to a beam 14 as shown in relation to panel 16*a* but may be attached to a column 12, as shown in relation to panel 16*b*, if access to a suitable beam is difficult. Brackets 18 preferably bear substantially all of the weight of the panel 16 so as to feed the load directly into the columns 12, although bracket 20 may also bear some load if required. Each bracket 18 may help to support two adjacent panels, as shown in relation to panels 16*a* and 16*c*.

As will be explained, in addition to attaching the panel 16 to the framework 10, the brackets 18 and 20 provide means for adjusting the position of the panel once it has been attached to the framework. It is envisaged that the brackets 18 are adjustable to move the panel along a vertical axis and also along a horizontal axis towards and away from the framework 10. These axes will be referred to respectively as the 'z-axis' and the 'y-axis' in the remainder of the specification. It is furthermore envisaged that bracket 20 is adjustable to move the panel along a horizontal axis across the face of the framework 10, and for convenience this axis will be referred to henceforth as the x-axis. The x, y and z axes are mutually perpendicular to one another.

Figure 2A:
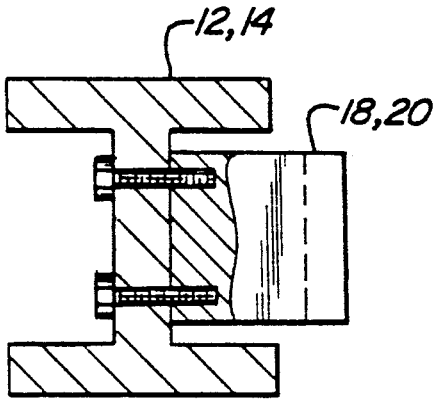
Figure 2B:
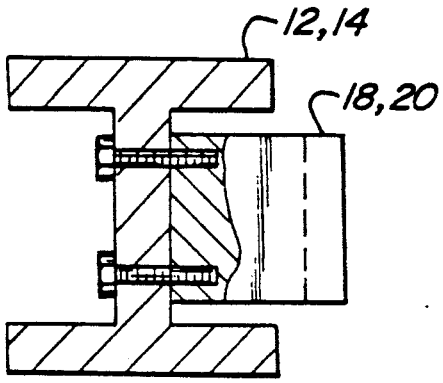

The members 12,14 constituting the framework 10 are typically of 'I' section; FIG. 2(*a*) shows that a bracket 18,20 may be attached to the web, and FIG. 2(*b*) shows that a bracket may alternatively be attached to the flange of a member if required. It is also possible to attach a bracket 18,20 to a floor slab or to set the bracket into a floor slab, as will be explained.

Figure 3:
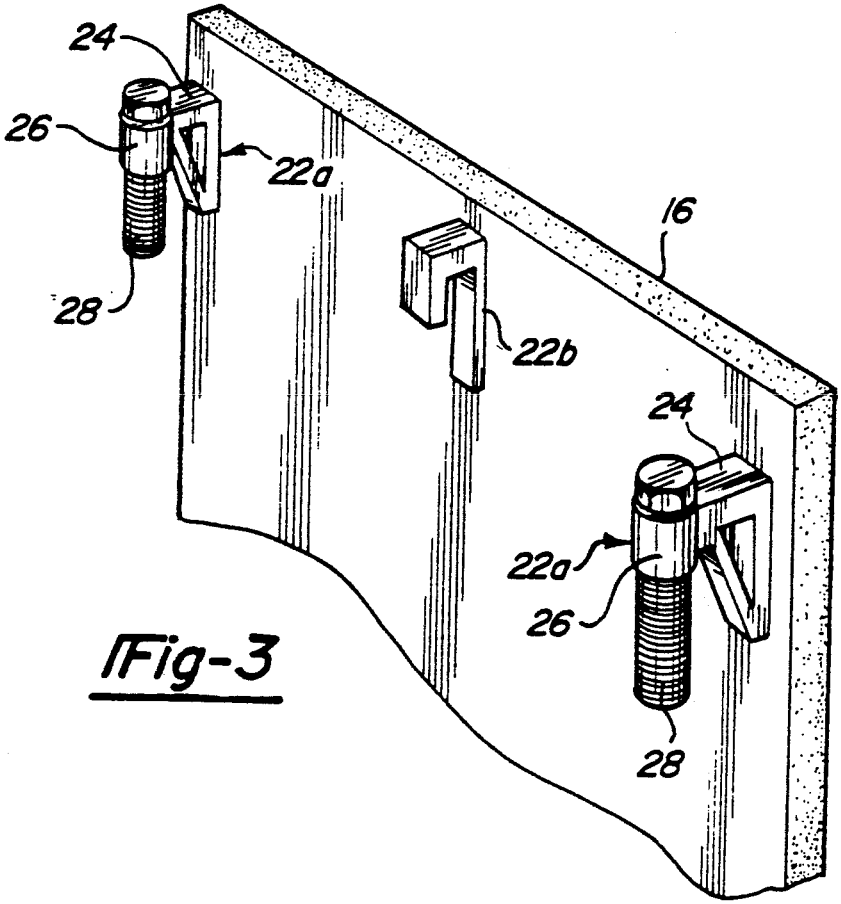
FIG. 3 is a rear perspective view of a cladding panel for use with the bracket system of this invention.

FIG. 3 shows a panel 16 provided with hooks 22 attached to its upper back surface, by which means the panel may be attached to the framework 10 through brackets 18 and 20. The outer hooks 22*a* for attachment to brackets 18 each include an arm 24 extending perpendicularly from the panel. The arm 24 has a threaded sleeve 26 at its free end within which a screw jack member 28 can turn about its longitudinal axis, the jack member being substantially parallel with the back surface of the panel and being threadedly engaged within the sleeve. The inner hook 22*b* for attachment to bracket 20 preferably has a fixed, downwardly depending member instead of a screw jack member 28.

Figure 4:
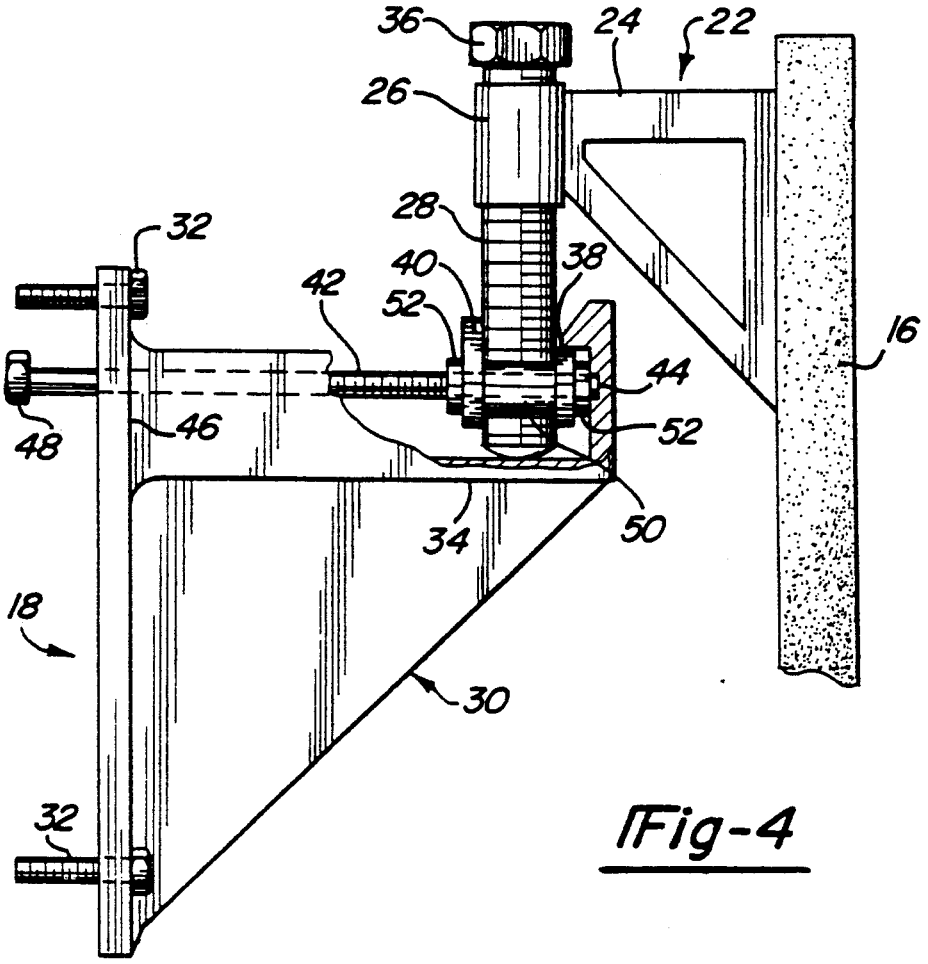
FIGS. 4 and 5 are part-sectioned side and top views respectively, showing one form of bracket according to this invention.
Figure 5:
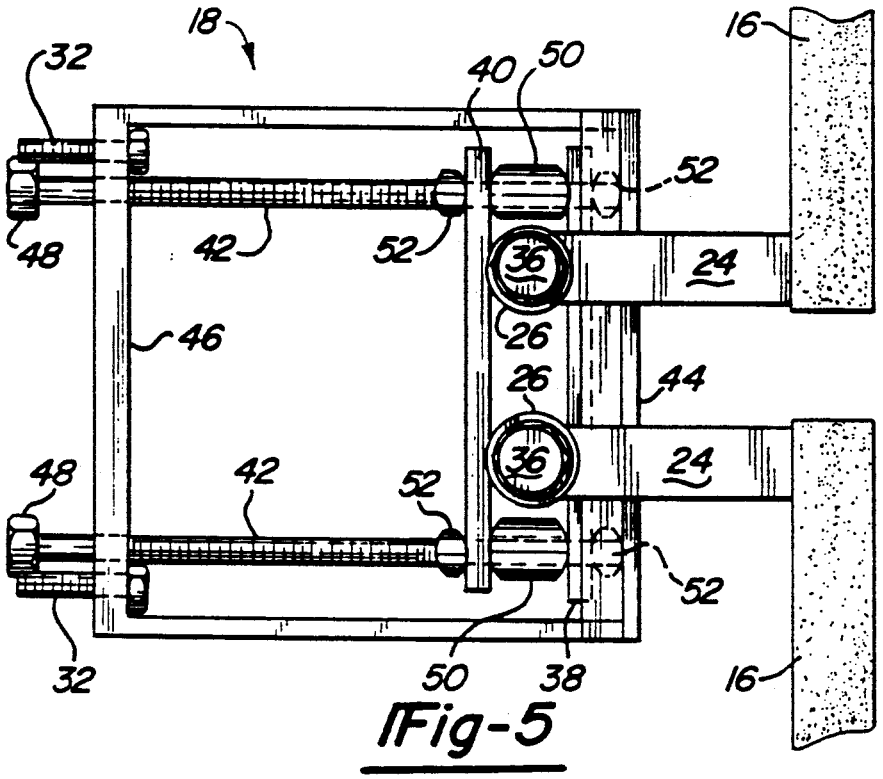

An embodiment of bracket 18 is shown in FIGS. 4 and 5, and comprises a body 30 which is preferably of welded mild steel construction and which may be attached to the framework 10 or to a floor slab by any suitable means such as the bolts 32 shown. The body 30 includes a load-bearing lower wall 34 upon which the lower end of the jack member 28 can rest so as to transmit the weight of the panel 16 into the framework 10. The height of the panel 16 relative to the bracket 18 may readily be altered by turning the jack member 28, which causes the sleeve 26 to move up or down the jack member (along the z-axis) thereby raising or lowering the panel as desired. The jack member may be turned by any convenient means, but is preferably turned by means of a nut 36 provided in an accessible position at the upper end of the jack member.

As has been mentioned, bracket 18 has a further function i.e. to provide adjustment along the y-axis to allow the panel to be mounted at the correct distance from the framework 10. In the illustrated embodiments, this facility is provided by means of a front plate 38 and a back plate 40, each of which has openings for receiving a pair of threaded rods 42 which extend from the front wall 44 to the rear wall 46 of the body 30. The respective ends of rods 42 are suitably located in recesses in the walls 44,46 such that each rod may only be moved angularly about its longitudinal axis. The rods 42 are preferably turned about their respective axes by nuts 48 provided at their rear ends, although the rods could alternatively be turned in synchronisation by means such as a common transverse shaft geared to both of the rods.

The plates 38,40 are held spaced apart by means of a spacer 50 and are caused to move along the rods 42, as the rods are turned, by blocks 52 which are threadedly engaged with the rods. The screw jack member 28 of the panel 16 is received in the gap between the plates 38,40 and is thus caused to move with the plates (along the y-axis) when the rods 42 are turned.

The back plate 40 is similar to front plate 38 but is extended upwardly so that the screw jack member 28 of a panel 16 may be readily positioned within the gap between the plates 38, 40. When the plates 38, 40 are wound into their fully-forward position, the front plate 38 is covered by an overhanging lip 54 which is shaped to guide the screw jack member into the gap between the plates 38, 40; this operation is facilitated by the upwards extension of back plate 40. Once the screw jack member 28 has been positioned, the rods 42 may be turned to wind the plates 38, 40 and the panel 16, into the desired position.

As best shown in FIG. 5, the gap between the plates 38, 40 is elongated and is suitable for receiving two hooks 22. This may be required when two panels 16 are positioned beside one another, the panels sharing a bracket 18 as shown in FIG. 1. Moreover, the hook or hooks 22 are free to move along the x-axis within the gap.

Figure 6:
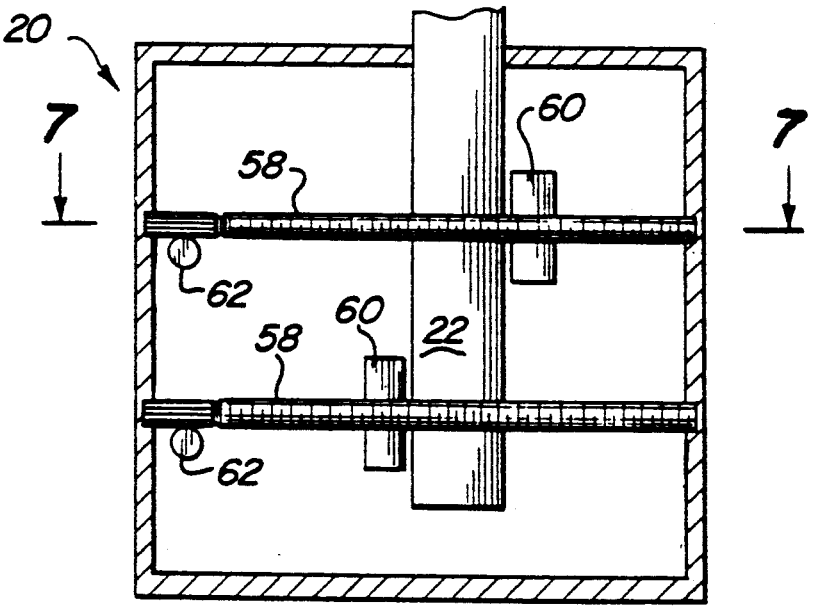
FIG. 6 is a sectional front view of another form of bracket according to this invention.
Figure 7:
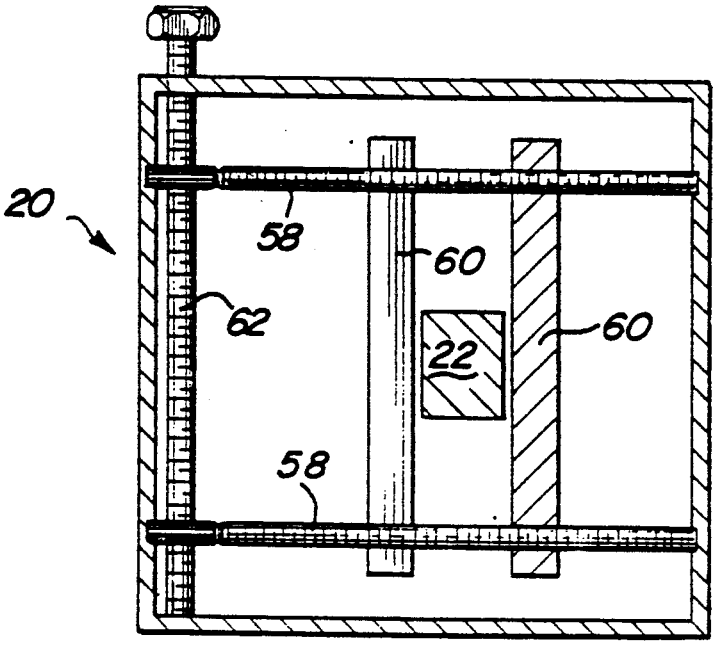
FIG. 7 is a cross-sectional view along line VII—VII of FIG. 6.

FIGS. 6 and 7 illustrate a possible arrangment for bracket 20, which is broadly similar to bracket 18 but which performs only one main function i.e. to provide horizontal movement, along the x-axis, across the face of the framework 10. To this end, bracket 20 includes two pairs of threaded rods 56 which are similar to the rods 42 in bracket 18 but are instead arranged parallel to the face of the framework 10. The pairs of rods 56 are arranged in different but parallel planes, one pair above the other, and each pair of rods carries an elongate plate 58. The rods 56 of each pair are threadedly engaged with respective ends of each plate 58 so that, when the rods of a pair are turned, the associated plate is caused to move along the rods. The two plates 58 in bracket 20 may thus be positioned to define a gap therebetween for receiving a hook 22 of a panel 16, and the hook and the panel may be moved along the x-axis by advancing one of the plates and withdrawing the other.

The rods 56 may be turned by any suitable means but it is preferred that each pair of rods has a common transverse shaft 60, each shaft being geared to both rods of its associated pair to turn the rods in synchronisation. It is preferred that each shaft 60 includes worm gears which mesh with worm wheels on the associated rods 56. Each shaft 60 is preferably turned by means of a nut located at the rear end of the shaft in an accessible position.

A modified arrangement of bracket 18 is shown in FIGS. 8 and 9. In this modified arrangement, the layout of bracket 18 is broadly similar to the arrangement shown in FIGS. 4 and 5 and common reference numerals are used where appropriate. Thus in FIGS. 8 and 9, the bracket 18 comprises an open-topped body 30 having a lower wall 34, a front wall 44 and a rear wall 46. The body contains a front plate 38, a back plate 40, plastic spacer tubes 50 and blocks 52, all of which are movable along a pair of threaded rods 42.

One immediately evident difference of the arrangement shown in FIGS. 8 and 9 vis-a-vis that shown in FIGS. 4 and 5 is the construction of the hook 22*a*. As best shown in FIGS. 9 and 10, the arm 24 of hook 22*a* comprises a double box section for stiffness and lightness. The arm 24 contains a tubular sleeve 62, which has an internally-threaded plate 64 fixed at its upper end. The plate 64 could be a welded-in nut.

The bolt 66 is coaxial with the sleeve 62 and is threadedly engaged within the plate 64, so as to move axially when turned by use of an exposed hexagonal head 68. The end of the bolt 66 within the sleeve 62 abuts a cylindrical spacer block 70 which in turn abuts a cylindrical steel pin 72. The spacer block 70 and the pin 72 are a close but sliding fit within the sleeve 62. The spacer block 70 reduces the slenderness ratio of the bolt 66.

In use, the pin 72 is supported by the lower wall 34 of bracket 18 in the manner of the screw jack member 28 of FIGS. 4 and 5. It is envisaged that the spacer block 70 can be used for coarse adjustment of height (along the z-axis) so that if the cladding panel 16 is too low, spacers can be added to the block 70. Conversely, if the panel 16 is too high, spacers can be taken away from the block 70. Fine z-axis adjustment may still be made by using the bolt 66, the spacer block 70 simply reducing the length of time needed to complete adjustment.

Another significant feature of the bracket shown in FIGS. 8 and 9 is the intermediate wall 74, which defines a well 76 within the body 30. The nuts 48 used to turn the threaded rods 42 are set into the well 76 and are readily accessible from within the building. The front ends of the threaded rods 42 have additional nuts 78 which are accessible from outside the building if necessary.

FIGS. 8 and 9 also show that a bracket may be attached to a concrete floor slab 80 instead of a beam or column. The bracket 18 illustrated is set into the floor slab 80 between columns during the concrete pouring operation. To this end, reinforcing rods 82 are attached to the bracket 18 to strengthen the fixing between the bracket 18 and the concrete matrix. Alternatively, the bracket 18 may be attached to a cured concrete floor slab by means of bolts extending through the lower wall 34. Of course, it is also possible that the arrangment shown in FIGS. 8 and 9 could be adapted for attachment to a beam or to a column, as previously described.

It will be noted that the rear wall 46 of bracket 18 is downwardly extended and that the reinforcing rods 82 are attached to the rear wall 46 above its centre. This arrangement converts bending forces into tensile forces along the reinforcing rods 82, when the bracket 18 is loaded. Moreover, the extended rear wall 46 acts to compress the concrete matrix. Thus, the bracket 18 of this invention converts a (vertical) load applied across the slab into a (horizontal) load directed through the slab, to the benefit of the slab's load capacity.

The bracket 18 may be set flush with an edge of the concrete floor slab 74 as shown in FIGS. 8, 9 and 11(*b*), or may be cantilevered as shown in FIG. (11*a*).

It will be clear that bracket 20 provides accurate positioning and firm support for the panel 16 along the x-axis, while allowing substantially free movement along the z- and y-axes. Similarly, bracket 18 allows movement along the x-axis but constrains the panel 16 against movement along the z- and y-axes. The panel 16 can therefore be accurately placed in three dimensions, and can be firmly supported in a given position, by adjustment of the brackets 18 and 20.

The three brackets 18, 20 of the embodiments described provide most support for the upper part of the panel 16. It is proposed that five brackets may be used on each panel of the lowest row of panels of a building, a further two brackets 18 being located towards the bottom of the panel to provide additional support for the lower part of the panel. Each panel in the rows above may then be linked to the panel immediately below so that the lower part of each panel is supported. This linking may be accomplished by any appropriate means, for example by means of engagement of a pin provided on an upper panel within a recess provided in a lower panel.

In some embodiments, bracket 20 can be replaced by a fixing which connects the back of a panel 16 to the framework 10 or to a floor member or the like. The fixing prevents movement along the x-axis while allowing movement along the y- and z-axes. The panel 16 can be positioned before being fixed using either a winch or a hydraulic jack to move the panel across the face of the framework 10.

As will be clear to those skilled in the art, this invention provides many advantages over existing bracket systems, and several of these advantages may be summarised as follows:

(i) The adjustability of the bracket 18, 20 provides considerable positioning tolerance, which means that the bracket may be attached to the framework members 12, 14 before the framework 10 is erected. To this end, the framework members 12, 14 may be pre-drilled with mounting holes for the brackets in order to minimize the positioning work required on-site. The brackets may also be placed with the steel reinforcement before casting of concrete floors. Indeed, the brackets may be attached to the framework members 12, 14 off-site during manufacture, which represents a substantial saving in on-site labour costs.

(ii) If desired, the cladding panels 16 may be attached to the framework 10 as soon as the framework is erected, because the brackets 18, 20 allow the panels to be moved into the correct position after installation and can allow for any subsequent movement of the framework during further construction work. This is particularly advantageous in the case of the 'fast-track' building system, in which it is important that the cladding panels are positioned as quickly as possible in order to allow further work to be carried out on a given part of the building. Moreover, once a row of panels has been attached to the framework all of the panels in the row may be moved into position before the row above is added.

(iii) The brackets 18, 20 allow the cladding panels 16 to be accurately positioned in spite of substantial inaccuracies in the positioning of the framework members 12, 14 to which the panels are attached. In particular, the brackets can compensate for inaccuracies arising from manufacturing defects in the framework members or the panels themselves, and can tolerate inaccurate assembly of the framework 10. Moreover, it will be clear that the brackets can allow for correction of defects which arise after the building has been completed, such as are caused by subsidence.

(iv) The cladding panels 16 can readily be removed and replaced, as may be required from time to time as a result of fire or other damage, or if the panels reach the end of their design life, or even if it is desired to replace the panels purely for aesthetic reasons. A panel may be removed and replaced individually, without disturbing the adjacent panels.

(v) The bracket system of this invention is particularly simple and convenient to use, and it is envisaged that all of the operations involved in attaching and positioning a panel 16 may be performed by unskilled persons with minimal supervision. Firstly, the hooks 22 provided on each panel may be easily located in their respective brackets 18, 20 thanks to features such as the extended back plate 40, the hooks being self-locating to a certain extent. Secondly, any necessary adjustments may be made with an ordinary spanner or the like and for example one man would be capable of moving a whole row of panels 5 mm to one side without difficulty. Thirdly, all adjustments may be made from inside the building, with no need for access to the outside if the brackets are fixed into position before the framework is erected. These advantages clearly lead to substantial savings in time, labour and therefore money.

(vi) The brackets 18, 20 can be used for any size or shape of panel 16, even on curved panels in which case the plates 38, 40, 58 may advantageously be curved instead of flat.

(vii) The brackets 18, 20 can readily accept movement of the panel 16 caused by thermal expansion or contraction.

I claim:

1. A bracket system for positioning and supporting a component on a structure, comprising;

a framework;

at lease one panel;

a plurality of brackets mounted on said framework, said brackets attaching said panel to said framework;

at least one hook connected to said panel, said hook engaging said brackets to support said panel thereon; and means for three-dimensional adjustment of said panel, said means for adjustment contained in said bracket.

2. The invention as described in claim 1, wherein said hooks each comprise an arm, said arm terminating in a threaded sleeve, said sleeve in turn housing a threaded screw member which is vertically adjustable.

3. The invention as described in claim 2, wherein said means for adjusting comprises front and back plates on said brackets, said plates separated by a spacer, said plates further receiving said threaded screw member of said hook in the space formed therebetween, said panels being vertically adjustable with respect to said bracket.

4. The invention as described in claim 3, wherein said means for adjusting further comprises threaded rods extending through front and rear walls of said bracket, said rods further extending through recesses in said front and back plates within said bracket, said panels being horizontally adjustable in the direction of said threaded rods and in the longitudinal direction of said space of said bracket.

5. The invention as described in claim 2, wherein said hook alternatively comprises a double box construction so as to provide light weight and rigid construction, said arm having a tubular sleeve with an internally threaded plate at its upper end.

6. The invention as described in claim 5, further comprising a bolt threadably engaging said plate and said sleeve, said bolt abutting a spacer block and a steel pin in sliding contact within said sleeve, said spacer block adjusting the height of said sleeve, said pin engaging said bracket.

7. The invention as described in claim 4, further comprising an intermediate wall within said bracket, said wall defining an open well enabling adjustment of said threaded rods from inside said framework by means of nuts connected to said rods, said nuts positioned on the opposing face of said wall within said open space defined by said well.

8. The invention as described in claim 2, wherein said bracket may alternatively be attached to a floor slab.

9. The invention as described in claim 8, wherein said brackets comprise reinforcing rods anchoring said brackets to said slab.

10. The invention as described in claim 9, wherein said brackets alternatively comprise bolts extending vertically downward through a lower wall of said bracket.

11. The invention as described in claim 2, wherein said framework further comprises vertical columns and horizontal beams.

* * * * *